US010854984B2

(12) United States Patent
Kim et al.

(10) Patent No.: US 10,854,984 B2
(45) Date of Patent: Dec. 1, 2020

(54) AIR-FILLED QUAD-RIDGE RADIATOR FOR AESA APPLICATIONS

(71) Applicant: THE BOEING COMPANY, Chicago, IL (US)

(72) Inventors: Yong U. Kim, Chicago, IL (US); Andrew G. Laquer, Chicago, IL (US)

(73) Assignee: The Boeing Company, Chicago, IL (US)

( * ) Notice: Subject to any disclaimer, the term of this patent is extended or adjusted under 35 U.S.C. 154(b) by 731 days.

(21) Appl. No.: 15/066,832

(22) Filed: Mar. 10, 2016

(65) Prior Publication Data

US 2017/0264011 A1 Sep. 14, 2017

(51) Int. Cl.

| | |
|---|---|
| ***H01Q 13/02*** | (2006.01) |
| ***H01Q 21/00*** | (2006.01) |
| ***H01Q 21/24*** | (2006.01) |
| ***H01Q 21/08*** | (2006.01) |
| ***H01Q 21/06*** | (2006.01) |

(52) U.S. Cl.

CPC ..... *H01Q 13/0225* (2013.01); *H01Q 13/0275* (2013.01); *H01Q 21/0087* (2013.01); *H01Q 21/0093* (2013.01); *H01Q 21/068* (2013.01); *H01Q 21/08* (2013.01); *H01Q 21/24* (2013.01)

(58) Field of Classification Search

CPC ..... H01Q 13/02; H01Q 13/0208; H01Q 13/0215; H01Q 13/0225; H01Q 13/0275; H01Q 21/0093; H01P 5/103; H01P 5/12; H01P 5/16; H01P 5/18

See application file for complete search history.

(56) References Cited

U.S. PATENT DOCUMENTS

| | | | | |
|---|---|---|---|---|
| 4,144,506 | A * | 3/1979 | McCammon | H01P 5/103 333/26 |
| 4,757,326 | A * | 7/1988 | Profera, Jr. | H01Q 3/0258 343/772 |
| 2004/0150554 | A1* | 8/2004 | Stenger | H01P 1/047 342/175 |
| 2005/0219137 | A1* | 10/2005 | Heisen | H01Q 13/02 343/776 |
| 2010/0238085 | A1* | 9/2010 | Fuh | H01Q 13/22 343/771 |
| 2015/0188238 | A1* | 7/2015 | Oppenlaender | H01Q 13/02 343/756 |
| 2016/0072190 | A1* | 3/2016 | Merk | H01Q 21/50 343/776 |

* cited by examiner

*Primary Examiner* — Daniel Munoz

(74) *Attorney, Agent, or Firm* — Haynes and Boone LLP

(57) ABSTRACT

A method of manufacturing an integrated radio frequency (RF) module, comprising structurally forming at least one RF waveguide and at least one RF radiator of a metalized ceramic material. The RF waveguide(s) and the RF radiator(s) are connected and operatively coupled with each other. Each of the RF radiator(s) comprises a metalized outer wall and at least one metalized axial ridge extending along an inner surface of the outer wall. The method further comprises sintering the metalized ceramic material to create a monolithic structure comprising the RF waveguide and RF radiator, and operatively coupling RF circuitry to the RF waveguide(s).

33 Claims, 14 Drawing Sheets

AIR-FILLED QUAD-RIDGE RADIATOR FOR AESA APPLICATIONS

FIELD

The present disclosure relates to a method of fabricating phased antenna arrays, and in particular, to a method for fabricating integrated radiator-transmit/receive modules (IRTRMs) using high temperature co-fired ceramic (HTCC) material for Active Electronically Scanned Arrays (AESAs).

BACKGROUND

Active Electronically Scanned Arrays (AESAs) are typically used in applications, such as phased array radar, where it is desirable to arbitrarily scan an electromagnetic beam at any one of a multitude of angles. An AESA may be defined as an array of antennas in which radiating elements are arranged in a grid form (such as rectangular or triangular), with each radiating element being associated with a phase shifter and variable gain amplifier to vary the excitation electronically in the element pattern, such that the array produces a steerable main beam in the desired pointing direction.

For example, with reference to FIG. 1, a radiator-waveguide portion 2 of an active electronically scanned array (AESA) 1 (shown in FIG. 2) typically comprises a cluster of transmit/receive (TR) modules 3 (transmit/receive circuitry not shown) and corresponding radiating elements 4 frontally located on the respective TR modules 3 to transmit and receive radar waves In the illustrated embodiment, four TR modules 3 are fabricated as one unit referred to a "quad-pack TR module 5," a plurality of which can be combined to incrementally increase the size of the AESA 1, as shown in FIG. 2.

Each TR module 3 comprises a waveguide 6 to which a respective radiating element 4 is mounted on the top end thereof. In the illustrated embodiment, the waveguides 6 are square for propagating two orthogonal linearly polarized signals. To this end, each TR module 3 further comprises two transmission lines 7*a*, 7*b* with two corresponding probes 8*a*, 8*b* inserted through the sidewalls of the waveguide 6 to produce two independent linearly polarized radio frequency (RF) signals in the form of TE10 and TE01 modes. Each radiating element 4 serves as an impedance transformer that matches the impedance of the respective waveguide 6 to free space impedance to efficiently radiate the RF signals. Each TR module 3 further comprises electronics (not shown in FIGS. 1 and 2) that control the amplitude and phase excitation of RF signals traveling through the waveguide 6 to the respective radiating element 4 to collectively create an aperture distribution across the AESA 1 that produces a dynamically directive beam, which can be rapidly scanned to transmit and receive RF signals to and from a designated target.

The quad-pack TR module 5 is fabricated utilizing a high temperature co-fired ceramic (HTCC) package taking the form of a multi-cavity, multi-layer substrate consisting of Aluminum Oxide (Alumina, $Al_2O_3$). The HTCC package may have metallization of ground planes and conductors, as well as feedthroughs or vertical vias for routing RF signals and direct current (DC) signals in three-dimensional space. The waveguides 6 are dielectric waveguides formed from HTCC material 9 during the fabrication of the quad-pack TR module 5. The relatively high dielectric constant of the HTCC material 9 (about 9-10) reduces the wavelengths of the propagating RF waves in the waveguides 6, thereby allowing them to be made smaller and thus more compact. The outer surfaces of the waveguides 6 are coated with a metallic material 10 to confine the propagating RF signals. Active circuits, such as monolithic microwave integrated circuits (MMICs) (not shown in FIGS. 1 and 2), are located in the various cavities of the HTCC package for generating and controlling the RF signals propagating through the respective waveguides 6 to the radiating elements 4.

Each radiating element 4 is rectangular for dual-polarization radiation, and has a larger aperture area than that of the respective waveguide 6 to facilitate radiation impedance matching. It is preferable that each radiating element 4 be as small as possible to facilitate denser radiating element 4 spacing, thereby preventing the formation of grating lobes, which are repeating main beams that begin to appear on the end-fire direction of the AESA 1 when the main beam is scanned too far. To this end, the radiating element 4 is a dielectric radiating element that is composed of a material 11 having a dielectric constant higher than that of the air, which allows the radiating element 4 to be made smaller or more compact. However, it is important that the material 11 not have a dielectric constant so high as to cause a mismatch between the radiating element 4 and free space. For these reasons, Duroid®, which has a dielectric constant of around 4, has been selected for the material 11. The outer surfaces of the radiating elements 4 are coated with a metallic material 12 (as depicted in the inset in FIG. 1) to confine the propagating RF signals to the apertures of the radiating elements 4.

As best shown in FIG. 2, the array of radiating elements 4 may be fabricated as a single piece radiator aperture plate 13, which is formed by a number of thin metalized Duroid® layers. Each radiating element 4 is formed by clearing the metalized multi-layer structure and surrounding the cleared volume with copper-plated through via holes for the electric wall. Significantly, because the radiator aperture plate 13 is composed of a Duroid® dielectric material that is incompatible with the high temperatures required to fabricate the quad-pack TR modules 5, the radiator aperture plate 13 must be fabricated separately from the quad-pack TR modules 5, and then subsequently mated to each other.

However, it has been found that perfectly mating the top-end of the quad pack TR modules 5 to the radiator aperture plate 13 is very difficult and prone to having misalignments and air gaps at the mating interface. Moreover, since the radiator aperture plate 13 is fabricated using soft materials, such as Duroid® and copper, and the quad-pack TR modules 5 are applying upward forces, over time, the radiator aperture plate 13 has a tendency to bow up at the center. Consequently, the AESA 1 tends to have RF leakage and mismatch losses, which are difficult and expensive to prevent. Furthermore, because the radiator aperture plate 13 and quad-pack TR modules 5 must be fabricated separately, the cost for fabricating the overall AESA 1 is increased due to additional post-manufacturing alignment, sealing, and tuning steps.

As such, there is a need to provide a more cost-effective and reliable technique for fabricating AESAs.

SUMMARY

In accordance with one aspect of the present inventions, a method of manufacturing an integrated radiator-transmit/receive module (IRTRM) at radio frequency (RF) is provided. Multiple ones of these RF modules may be affixed to each other to create a whole active electronically scanned array (AESA).

The method comprises structurally forming at least one RF waveguide (e.g., a dielectric waveguide) and at least one RF radiator from a metalized ceramic material. The RF waveguide(s) and the RF radiator(s) are connected and operatively coupled with each other. Each of the RF radiator(s) comprises an outer metalized wall and at least one axial metalized ridge extending along an inner surface of the outer wall. In one embodiment, a pair of opposing axial ridges extends along the inner surface of the outer wall. In another embodiment, two pairs of opposing axial ridges that are orthogonal to each other may extend along the inner surface of the metalized outer wall. The outer wall of each of the radiator(s) may be, e.g., rectangular or circular. Each of the RF radiator(s) may have a void filled with air.

The method further comprises sintering the metalized ceramic material to create a monolithic structure, and operatively coupling RF circuitry (e.g., RF transmit/receive circuitry) to the RF waveguide(s). The ceramic material may be, e.g., high temperature co-fired ceramic (HTCC) material that is sintered at a temperature greater than 1500° C., or the ceramic material may be low temperature co-fired ceramic (LTCC) material that is sintered at a temperature less than 900° C. One method further comprises structurally forming at least one RF transmission line from the ceramic material. The transmission line(s) is operatively coupled between the RF circuitry and the RF waveguide(s). In this case, the method further comprises simultaneously sintering the transmission line(s) with the RF waveguide(s) and the RF radiator(s) to create the monolithic structure. The method may further comprise disposing an electrically conductive material on exposed surfaces of the RF radiator(s) after the monolithic structure has been created.

In one method, forming the RF waveguide(s) and the RF radiator(s) from the ceramic material comprises laminating a plurality of ceramic material layers together, and wherein the ceramic material is metalized by forming electrically conductive patterns on at least one of the ceramic material layers prior to laminating the ceramic material layers together. The RF radiator(s) may be formed by forming a cutout in at least one of the ceramic material layers to create the axial ridge(s). The RF circuitry may comprise at least one monolithic microwave integrated circuit (MMIC), in which case, operatively coupling the RF circuitry to the RF waveguide(s) may comprise forming at least one cut out in at least one of the ceramic material layers, such that at least one cavity is formed in the monolithic structure, and affixing the MMIC respectively into the cavity(ies).

In accordance with another aspect of the present inventions, an IRTRM is provided. The integrated RF modules may be affixed to each other to create a whole active electronically scanned array (AESA). The RF module comprises at least one radiator, each of which includes an outer wall and at least one axial ridge extending along an inner surface of the outer wall. In one embodiment, a pair of opposing axial ridges extends along the inner surface of the outer wall. In another embodiment, two pairs of opposing axial ridges that are orthogonal to each other may extend along the inner surface of the outer wall. The outer wall of each of the RF radiator(s) may be, e.g., rectangular or circular. Each of the RF radiator(s) may have a void filled with air.

The RF module further comprises at least one waveguide (e.g., a dielectric waveguide) respectively operatively coupled to the RF radiator(s), and RF circuitry (e.g., RF transmit/receive circuitry) operatively coupled to the at least one RF waveguide. The RF radiator(s) and the RF waveguide(s) are formed of a monolithic metalized ceramic structure (e.g., high temperature co-fired ceramic (HTCC) material or low temperature co-fired ceramic (LTCC) material), and the RF circuitry is affixed to the monolithic metalized ceramic structure. In one embodiment, the RF module further comprises at least one RF transmission line operatively coupled between the RF circuitry and the RF waveguide(s). In this case, the RF transmission line(s) is formed of the monolithic metalized ceramic structure. Each of the RF transmission line(s) may comprise a probe extending into a respective one of the RF waveguide(s). In another embodiment, the monolithic metalized ceramic structure comprises at least one cavity, and the RF circuitry comprises at least one monolithic microwave integrated circuit (MMIC) respectively affixed within the cavity(ies).

Other and further aspects and features of the invention will be evident from reading the following detailed description of the preferred embodiments, which are intended to illustrate, not limit, the invention.

DRAWINGS

The drawings illustrate the design and utility of preferred embodiments of the present invention, in which similar elements are referred to by common reference numerals. In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which:

Figure 3:
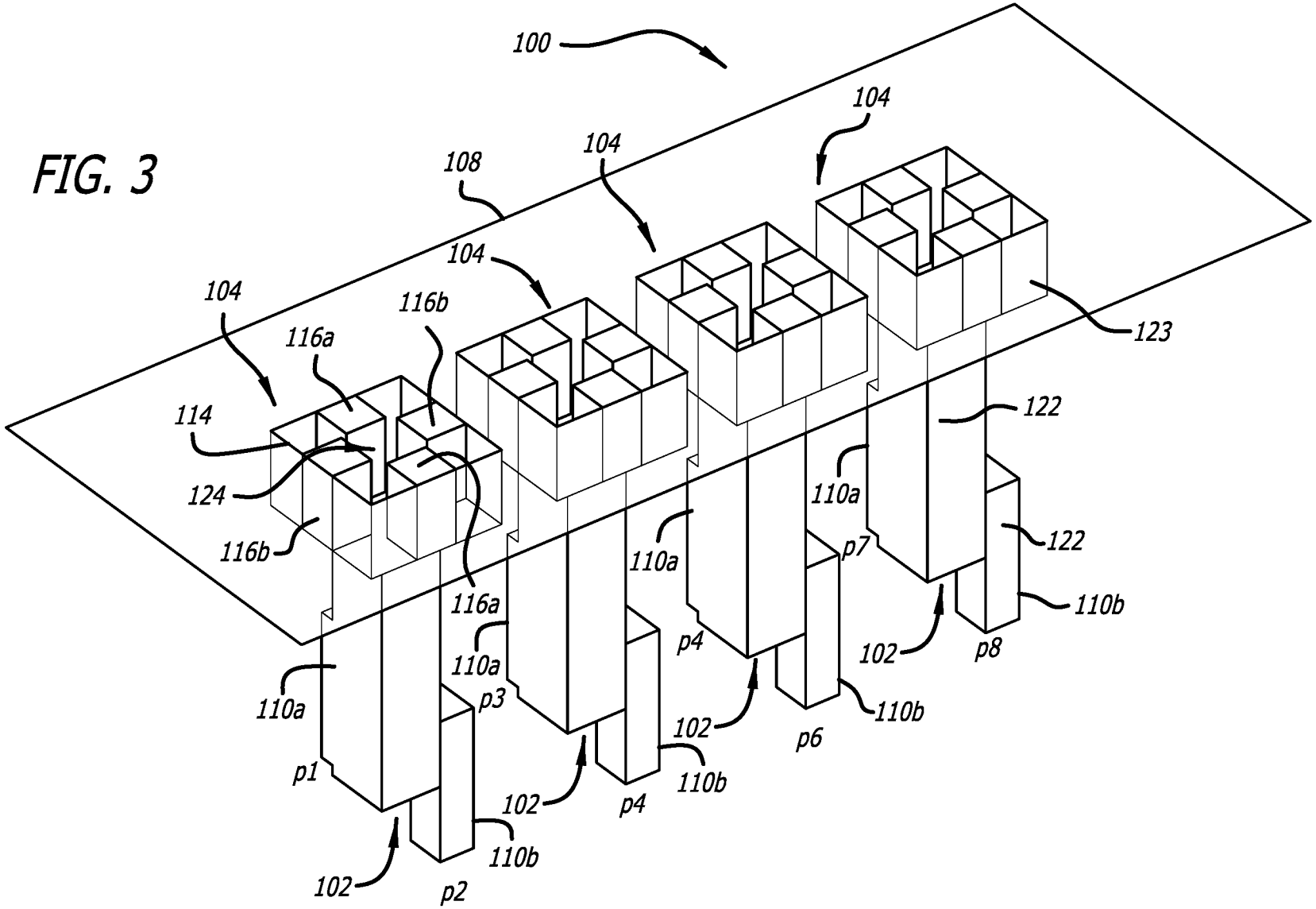
FIG. 3 is perspective view of the radiator-waveguide portion of a quad-pack radio frequency (RF) module constructed in accordance with one embodiment of the present inventions.
Figure 9A:
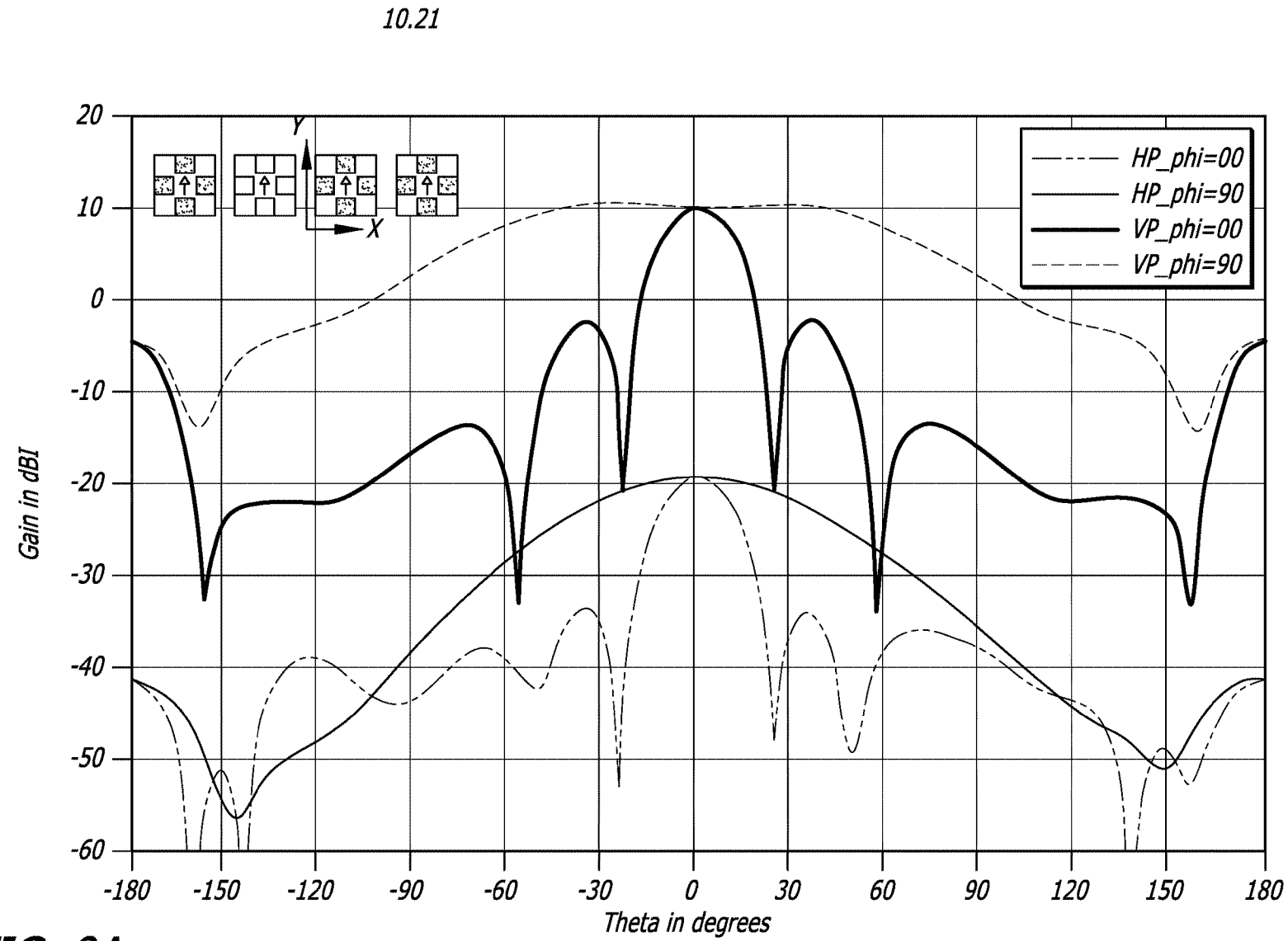
Figure 9B:
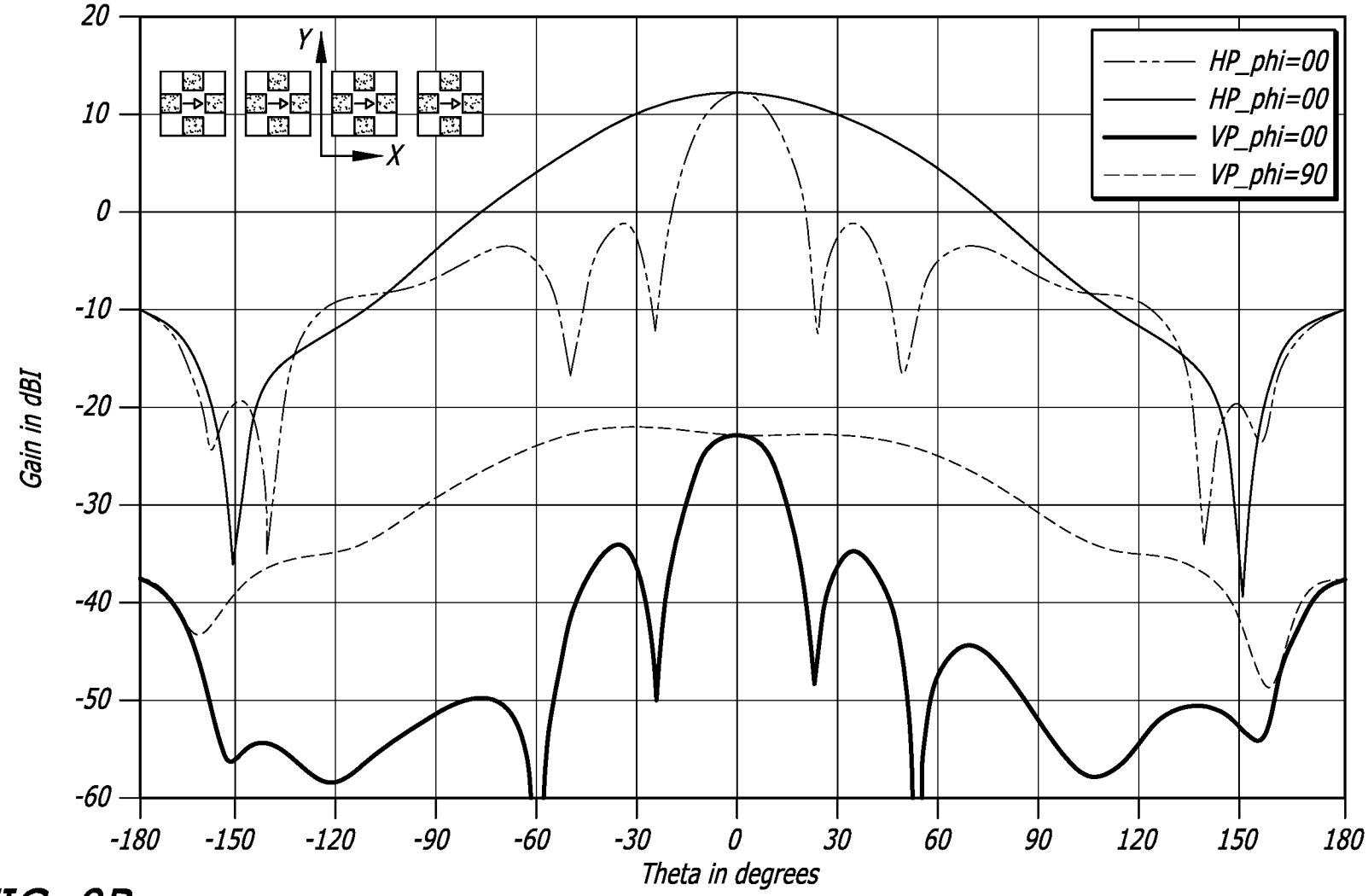
Figure 10:
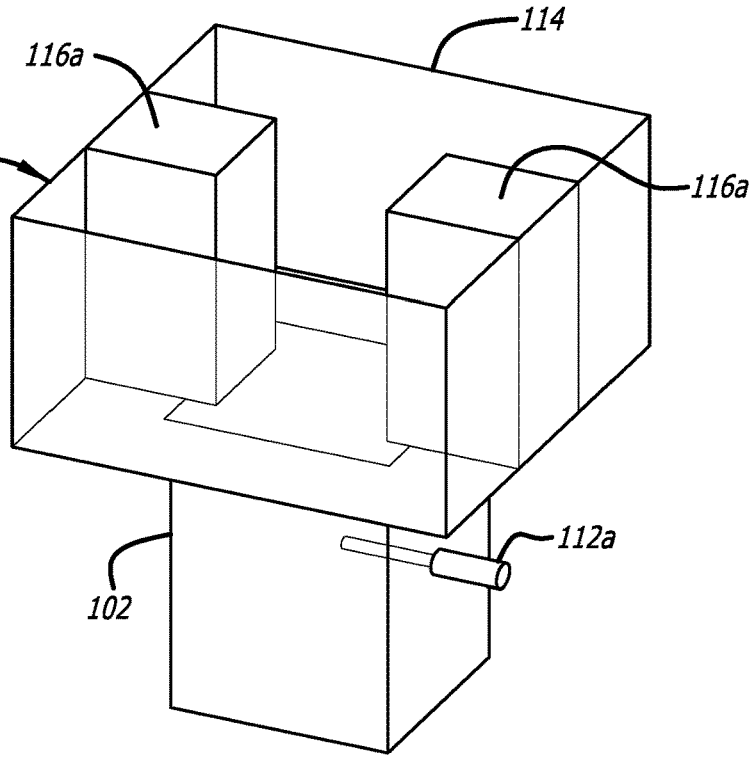
Figure 11:
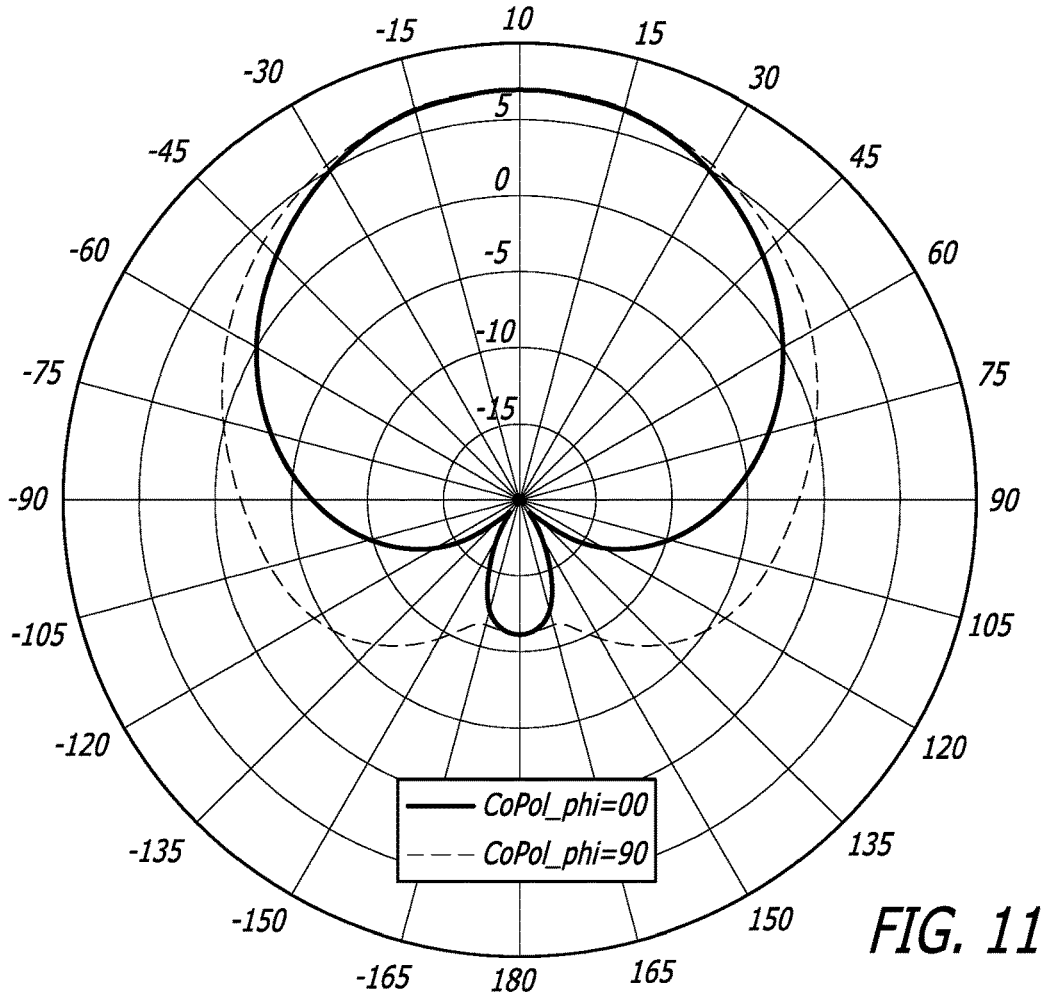
Figure 12:
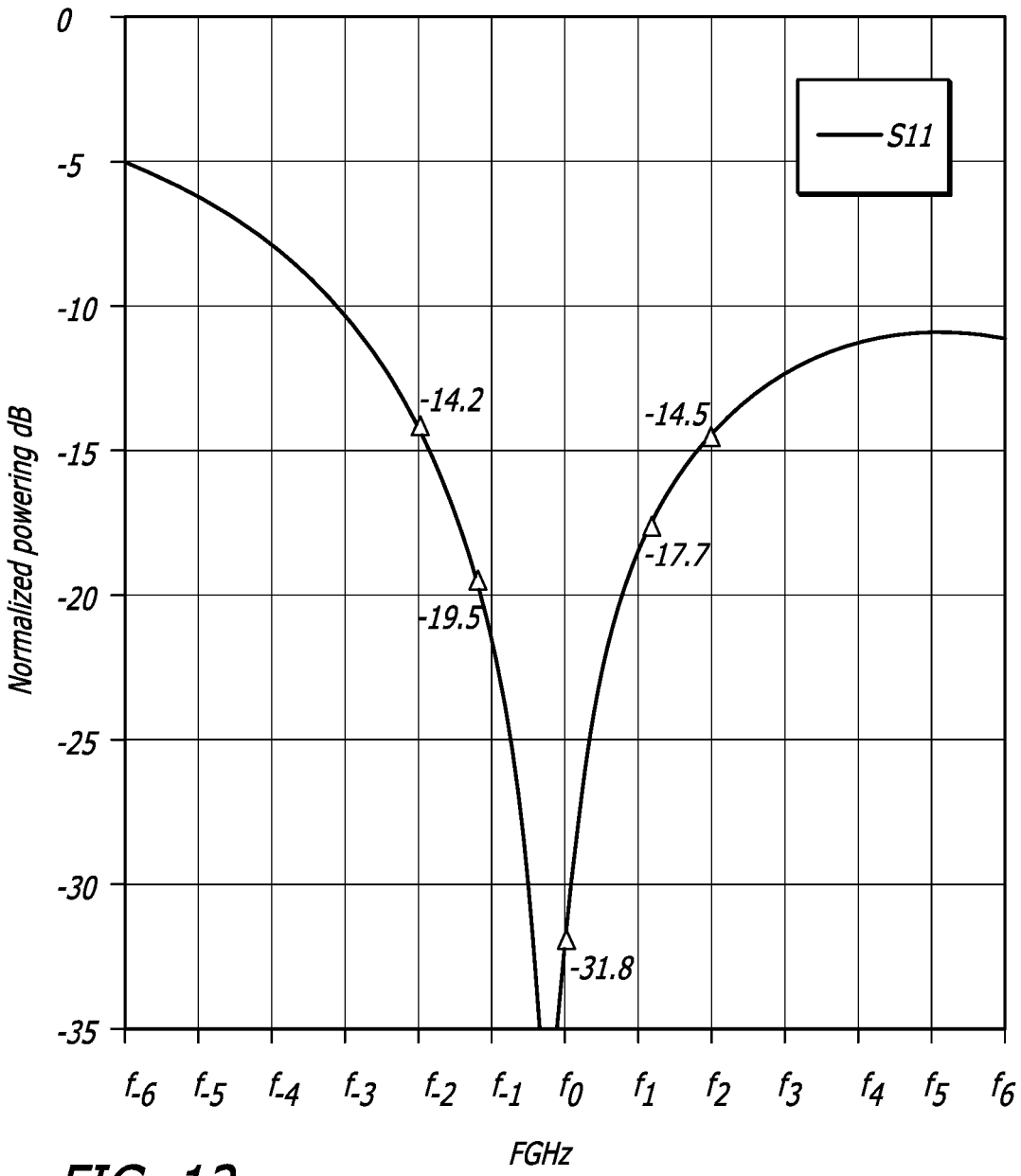
Figure 13:
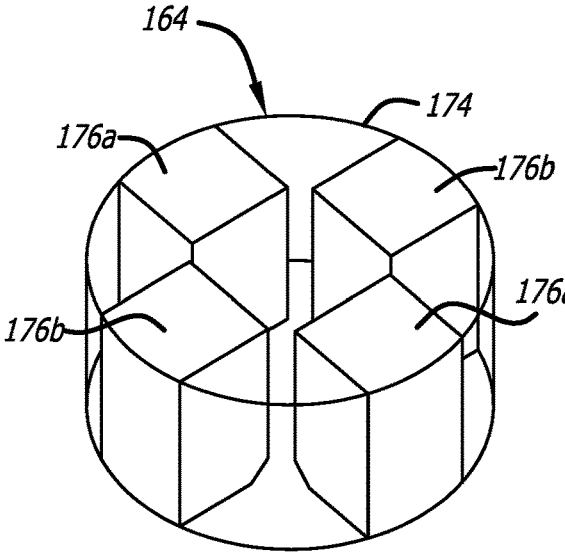
Figure 14:
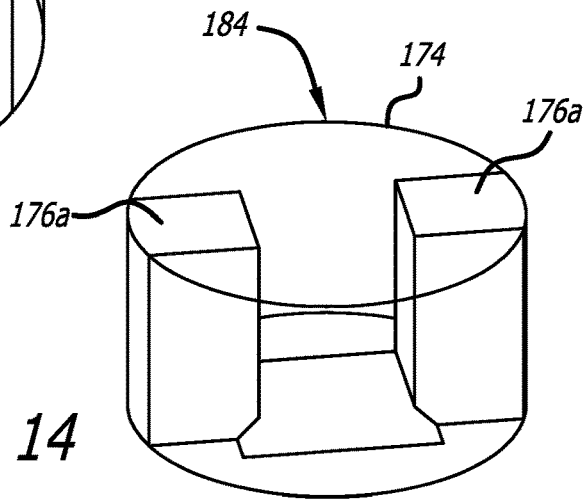
Figure 15:
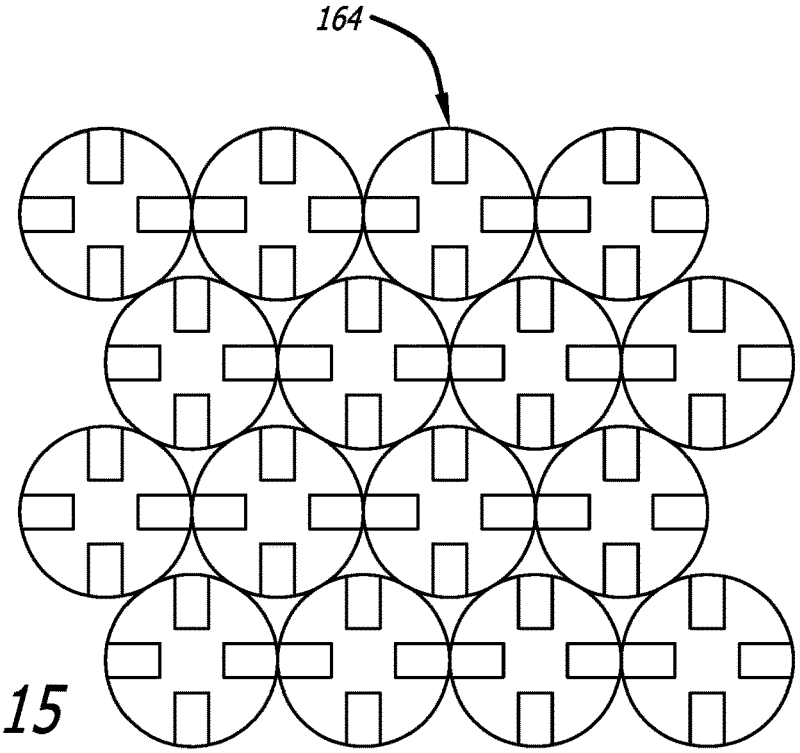
Figure 16:
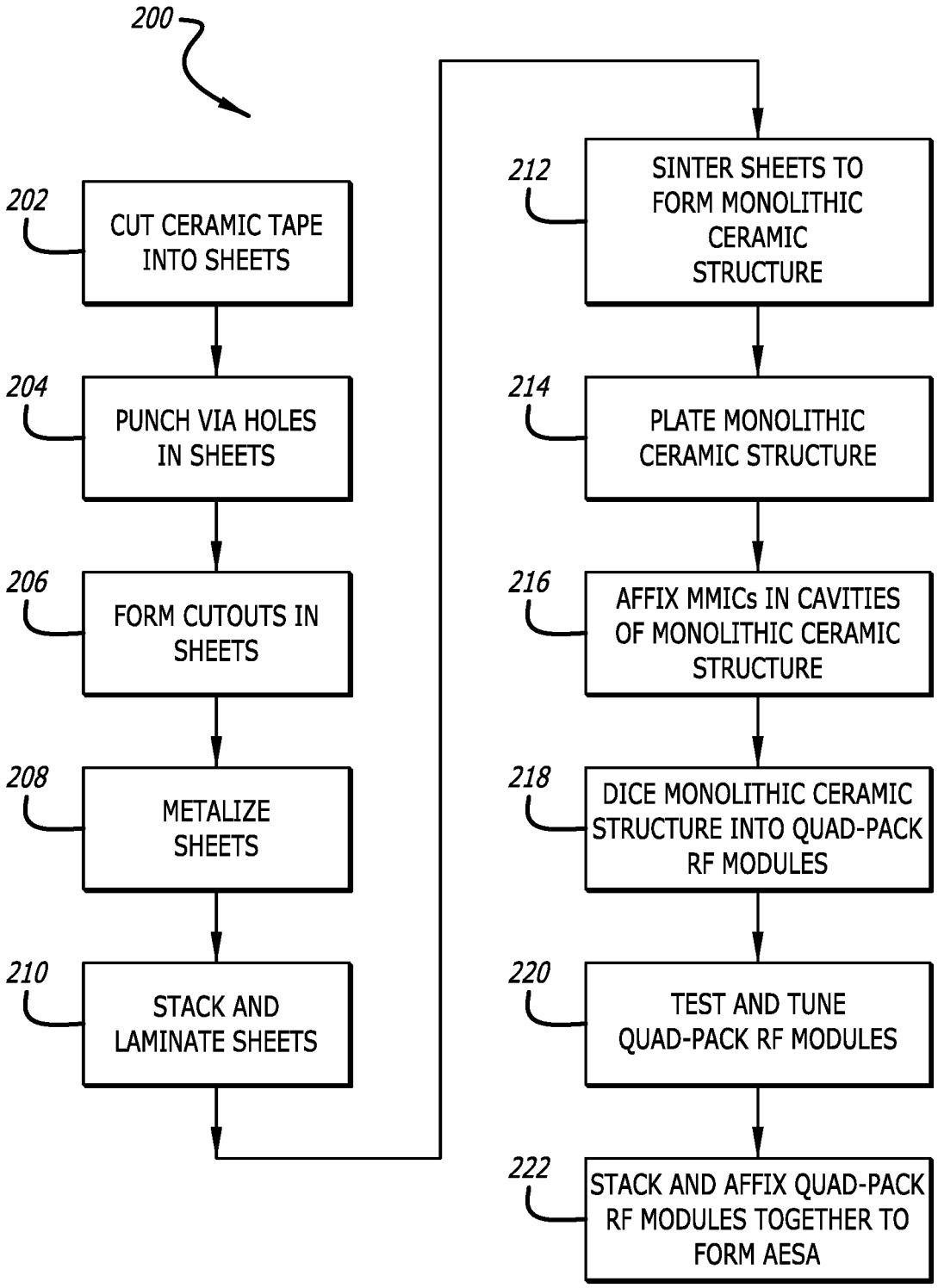

FIG. 9*a* is a plot of simulated co-pol and cross-pol gain curves of the radiator-waveguide portion excited with a vertically polarized RF signal;

FIG. 9*b* is a plot of simulated co-pol and cross-pol gain curves of the radiator-waveguide portion excited with a horizontally polarized RF signal;

FIG. 10 is a perspective view of a rectangular air-filled bi-ridge radiator and corresponding waveguide that can be alternatively be used in the quad-pack RF module of FIG. 3;

FIG. 11 is a plot of a simulated co-pol gain pattern of the bi-ridge radiator and corresponding wave guide of FIG. 10;

FIG. 12 is a plot of a simulated return loss of the bi-ridge radiator and corresponding wave guide of FIG. 10;

FIG. 13 is a perspective view of a circular air-filled quad-ridge radiator that can be alternatively be used in the quad-pack RF module of FIG. 3;

FIG. 14 is a perspective view of a circular air-filled bi-ridge radiator that can be alternatively used in the quad-pack RF module of FIG. 3 for single linear polarization applications;

FIG. 15 is a plan view of a radiating element distribution pattern of circular air-filled quad-ridge radiators that can be used for an AESA constructed with the quad-pack RF modules of FIG. 3; and FIG. 16 is a flow diagram of one method of manufacturing an AESA using the quad-pack RF module of FIG. 3.

Each figure shown in this disclosure shows a variation of an aspect of the embodiments presented, and only differences will be discussed in detail.

DESCRIPTION

Figure 4:
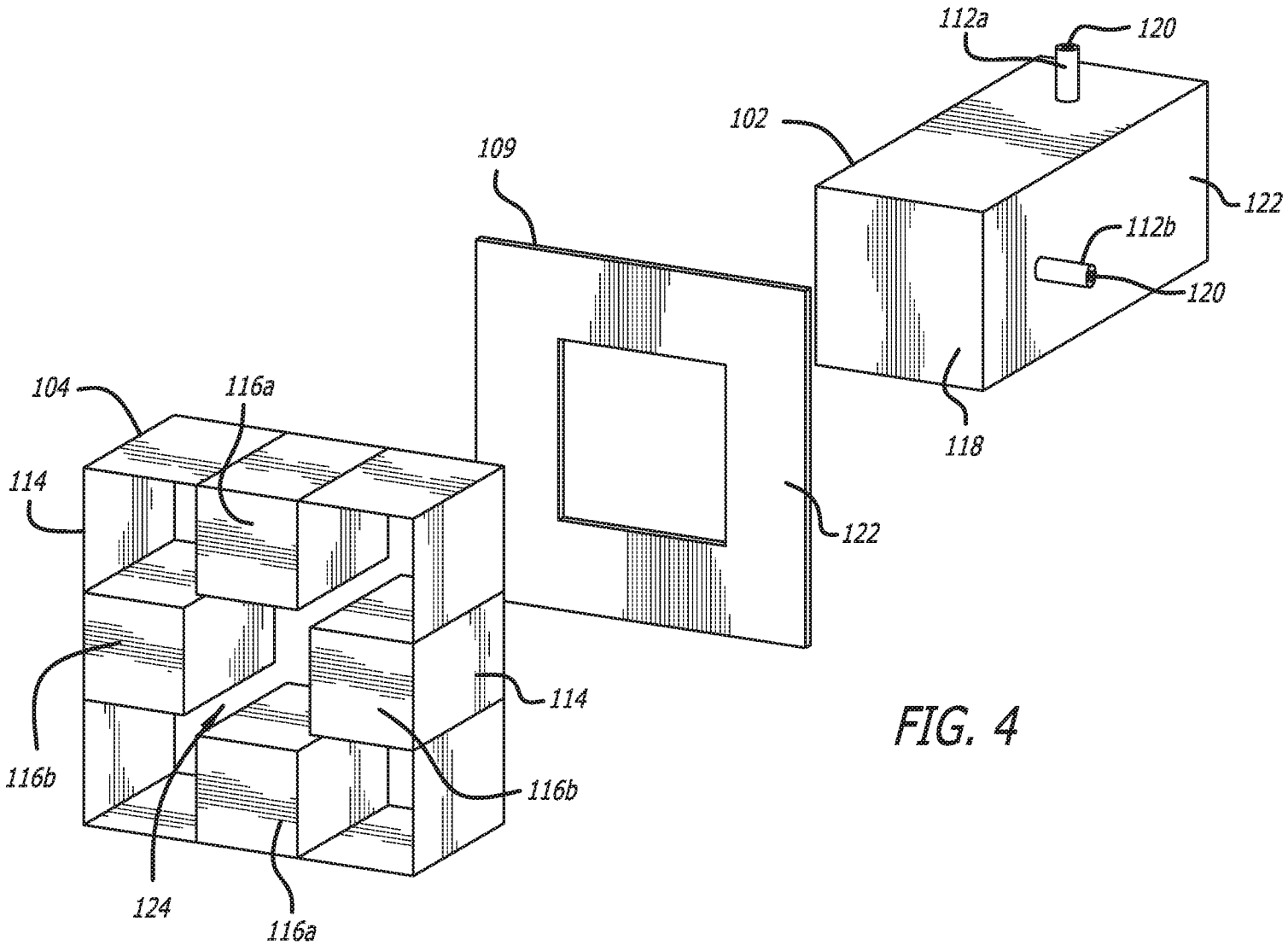
FIG. 4 is a perspective exploded view of a rectangular air-filled quad-ridge radiator and corresponding waveguide of the quad-pack RF module of FIG. 3.
Figure 5:
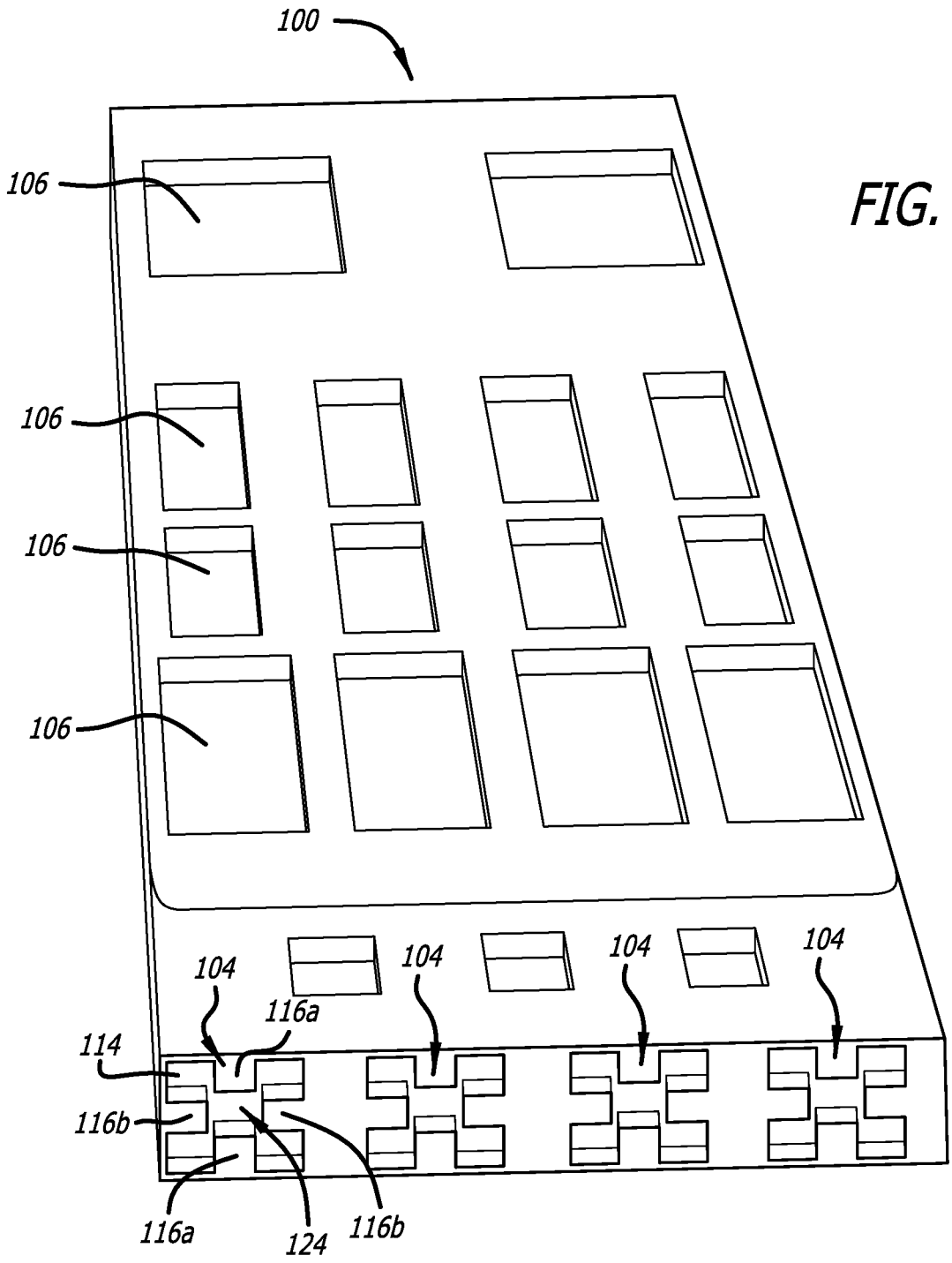
FIG. 5 is a perspective view of an actual quad-pack RF module constructed in accordance with one embodiment of the present inventions.

Referring to FIGS. 3-5, an integrated radio frequency (RF) module 100 constructed in accordance with one embodiment of the present inventions will now be described. Several of the RF module 100 may be stacked and bonded together to form an active electronically scanned array (AESA), or the RF module 100, by itself, may form a single IRTRM active AESA.

The RF module 100 topologically comprises a plurality of waveguides 102 and a plurality of radiators 104 operatively coupled to the respective waveguides 102. In the illustrated embodiment, the RF module 100 takes the form of a quad-pack RF module 100, meaning that there are four sets of waveguides 102 and radiators 104. Of course, the RF module 100 may comprise more or less sets of waveguides 102 and radiators 104, including only one waveguide 102 and one radiator 104. As best shown in FIG. 5, the RF module 100 further comprises transmit/receive circuitry 106, which in the illustrated embodiment, takes the form of monolithic microwave integrated circuits (MMICs), and any electrical traces and vias necessary to electrically couple the MMICs together. The RF module 100 further comprises an electrically conductive ground plane 108 disposed on the top opening of the radiators 104, and an electrically conductive ground plane 109 disposed between the radiators 104 and waveguides 102, to prevent back radiation.

In the illustrated embodiment, each waveguide 102 is rectangular and may support linearly polarized RF signals. For each waveguide 102, the RF module 100 further comprises a pair of RF transmission lines 110*a*, 110*b* with corresponding electrically conductive probes 112*a*, 112*b* (only shown in FIG. 4) that extend into the respective waveguide 102 for independently launching a vertically polarized RF signal (TE10 mode) and a horizontally polarized RF signal (TE01 mode) that propagate down the length of the waveguide 102. Thus, each waveguide 102 includes two input ports respectively associated with the vertically and horizontally polarized RF signals. As a result, the RF module 100 has eight ports total, labeled P1-P8, with the odd ports P1, P3, P5, and P7 corresponding to the vertically polarized RF signals, and the even ports P2, P4, P6, and P8 corresponding to the horizontally polarized RF signals. The vertically and horizontally polarized RF signals are transmitted and received by the transmit/receive circuitry 106 via the respective probes 112*a*, 112*b*. When implemented in or as an AESA, the transmit/receive circuitry 106 may control the amplitude and phase of the RF signals propagating through the associated waveguide 102 relative to the other waveguides 102.

Each radiator 104 takes the form of air-filled quad-ridge radiator. To this end, each radiator 104 comprises an outer metalized rectangular wall 114 (the first radiator wall 114 shown in phantom) and at least one axial ridge 116 extending along the inner surface of the outer wall 114. At least one pair of opposing ridges 116 may extend within the outer wall 114, and in the embodiment illustrated in FIGS. 3 and 4, t, two orthogonal pairs of opposing axial ridges 116 extend within the outer wall 114, one pair 116*a* that advantageously interacts with the vertically polarized RF signal, and the other pair 116*b* that advantageously interacts with the horizontally polarized RF signal. Significantly, the ridges 116 operate to move the cut-off frequency of the respective radiator 104 in both dimensions further down on the frequency spectrum, so that the aperture size of the radiator 104 may be reduced, thereby allowing the radiators 104 to be more densely spaced, and consequently, eliminating or at least suppressing the appearance of the grating lobes when the main beam is directed towards the end-fire direction of the AESA.

Figure 6:
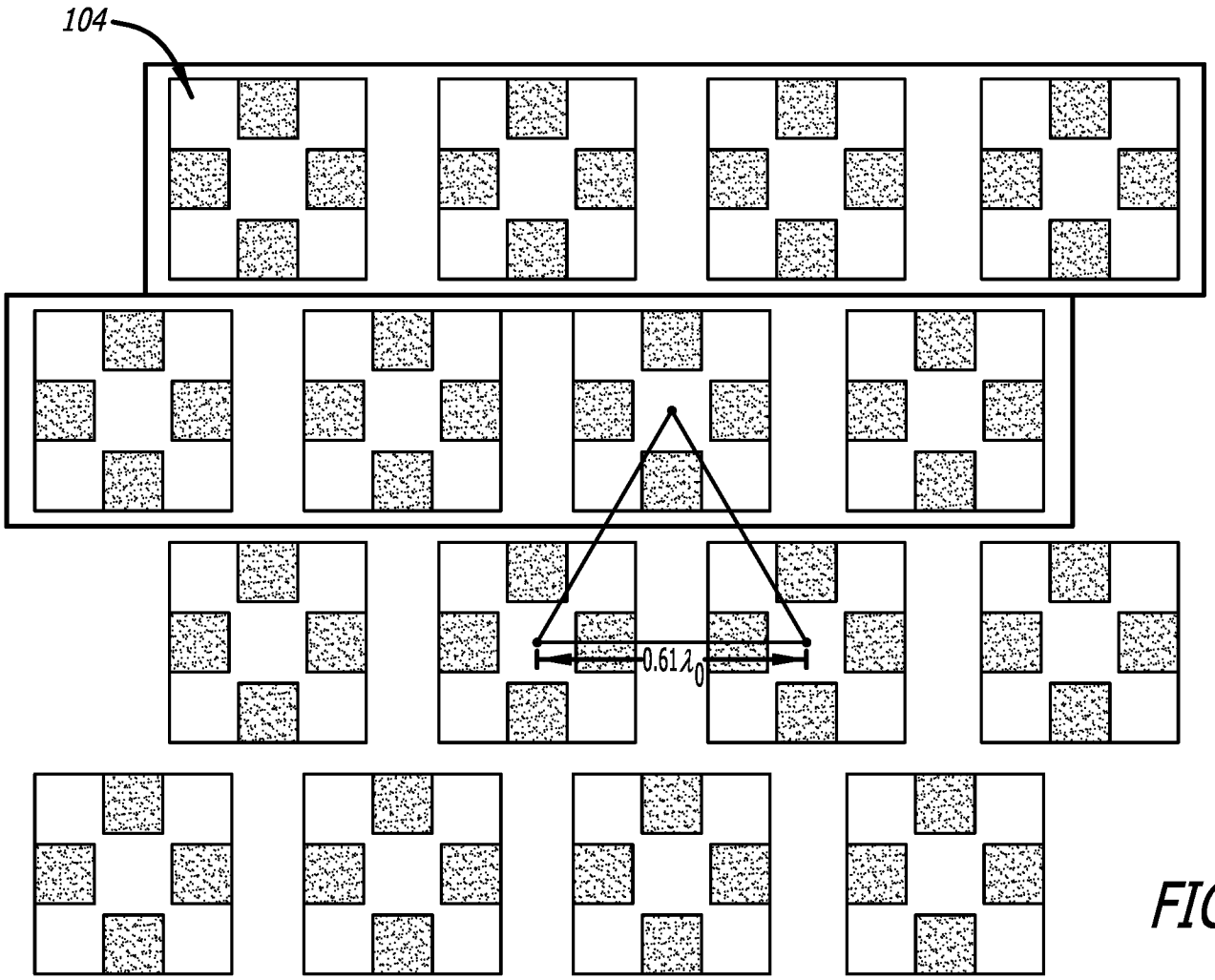
FIG. 6 is a plan view of a radiating element distribution pattern of rectangular air-filled quad-ridge radiators that can be used for an AESA constructed with the quad-pack RF modules of FIG. 3.

For example, referring to FIG. 6, the radiators 104 may be arranged in an array using an equilateral triangle grid with 0.61 nominal free space wavelength ($\lambda_0$) side spacing. This element spacing can only be met by miniaturizing the radiator size. It has been observed that in this radiator array configuration, at a center frequency ($F_0$) and over 6% bandwidth, the main beam can be scanned off boresight more than forty-five degrees in any direction while avoiding grating lobes.

The waveguides 102, radiators 104 (including the ridges 116), and transmission lines 110 are all formed of a monolithic metalized ceramic structure. In the illustrated embodiment, this monolithic ceramic structure is composed of a high temperature co-fired ceramic HTCC material. In particular, the supporting structure of the waveguides 102, radiators 104, and transmission lines 110 are composed of an HTCC material 118 (e.g., Aluminum Oxide (Alumina, $Al_2O_3$) with tungsten and molymanganese metallization) (shown only in FIG. 4 with respect to the waveguide 102). Alternatively, the monolithic metalized ceramic structure of the waveguides 102, radiators 104, and transmission lines 110 may be composed of an LTCC material (e.g., a glass-ceramic composite with silver, copper, or gold metallization).

In the illustrated embodiment, each of the transmission lines 110 comprises an electrical center conductor 120 (shown in FIG. 4) embedded within the HTCC material 118 (not shown with respect to the transmission lines 110), with the outer surface of the transmission lines 110 being coated with an electrically conductive material 122. The waveguides 102 are dielectric waveguides composed of a ceramic material, so that they can be made as small and compact as possible. Thus, the HTCC material 118 form the core of the waveguides 102, the outer surface of which is coated with the electrically conductive material 122. Significantly, because the ridges 116 have effectively reduced the cut-off frequency of the radiator 104, thereby allowing the aperture size of the radiator 104 to be decreased for dense packing in an AESA, the radiator 104 need not be filled with any dielectric material, such as the aforementioned Duroid® material. Instead, voids 124 of the radiator 104 (i.e., the space in the radiator 104 not occupied by the axial ridges 116) are filled with air. The outer and inner surfaces of the radiator 104, including the ridges 116, are coated with an electrically conductive material 123, which is the same conductive material 122 that coats the waveguides 102, ground plane 108, and transmission lines 110.

Thus, as will be described in further detail below, the radiators 104 may be co-manufactured with the waveguides 102, as well as the transmission lines 110, in an integrated RF module 100 may be manufactured as a single integrated unit using a highly accurate high temperature co-fired ceramic (HTCC) process, or alternatively an equally highly accurate low temperature co-fired ceramic (LTCC) process. The HTCC or LTCC process produces an integrated RF module 100 with tight dimensional accuracy that is also free of misalignment and gaps in the junction between the radiators 104 and waveguides 102. These attributes eliminate RF mismatch and RF leakage resulting in improved RF performance. The integrated RF module 100 may be mass produced in a form that is factory-tuned and with a reliable and repeatable RF performance, so that it requires no additional post-manufacturing procedures to align, seal, tune, and test. A large AESA is simply formed by stacking several integrated RF modules 100 over a specified planar space. Thus, this integrated RF module process results in lower manufacturing costs, higher production yields, and improved reliability, since there are fewer manufacturing steps.

Figure 1:
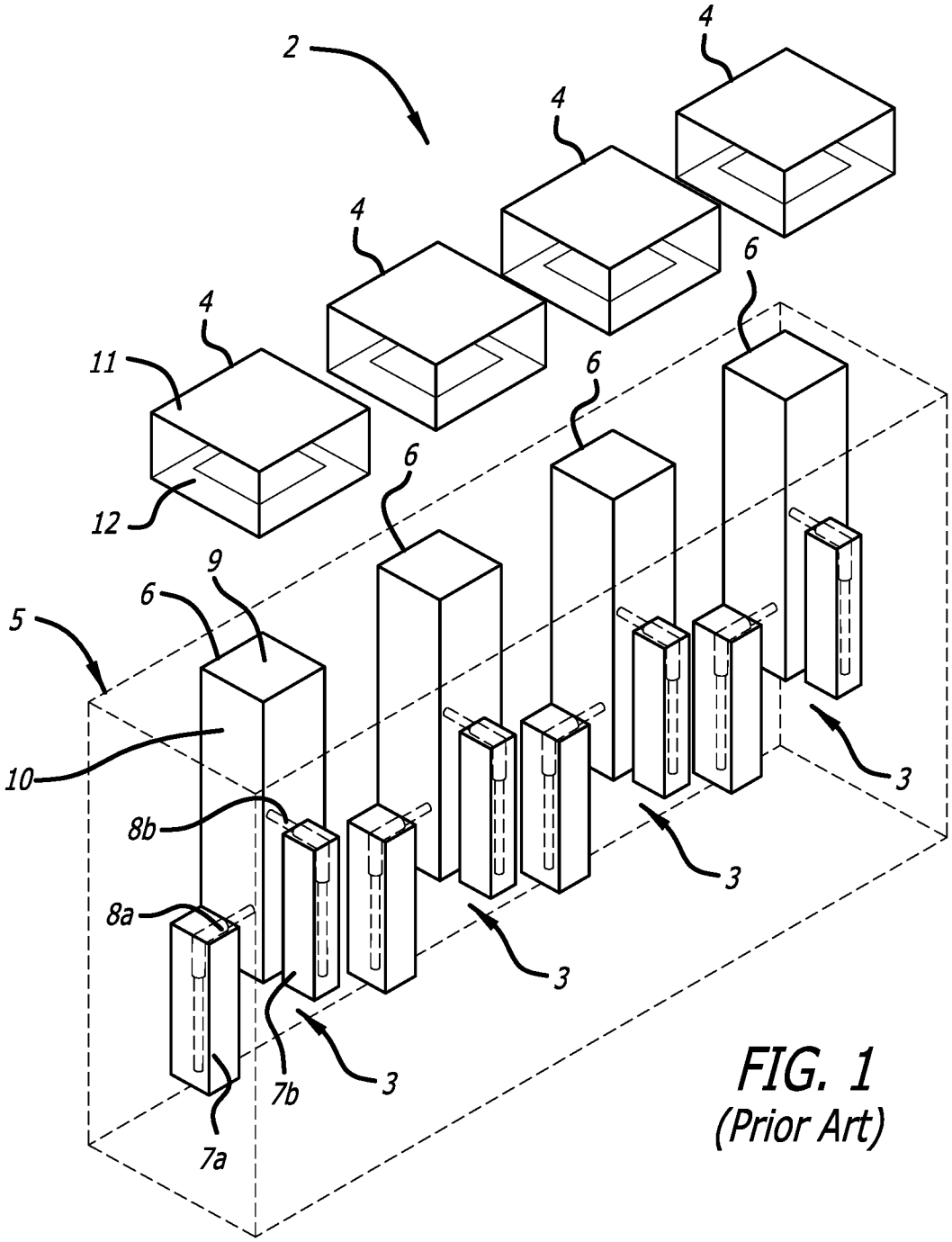
FIG. 1 (Prior Art)
FIG. 1 is a perspective exploded view of the radiator-waveguide portion of a prior art active electronically scanned array (AESA)
Figure 2:
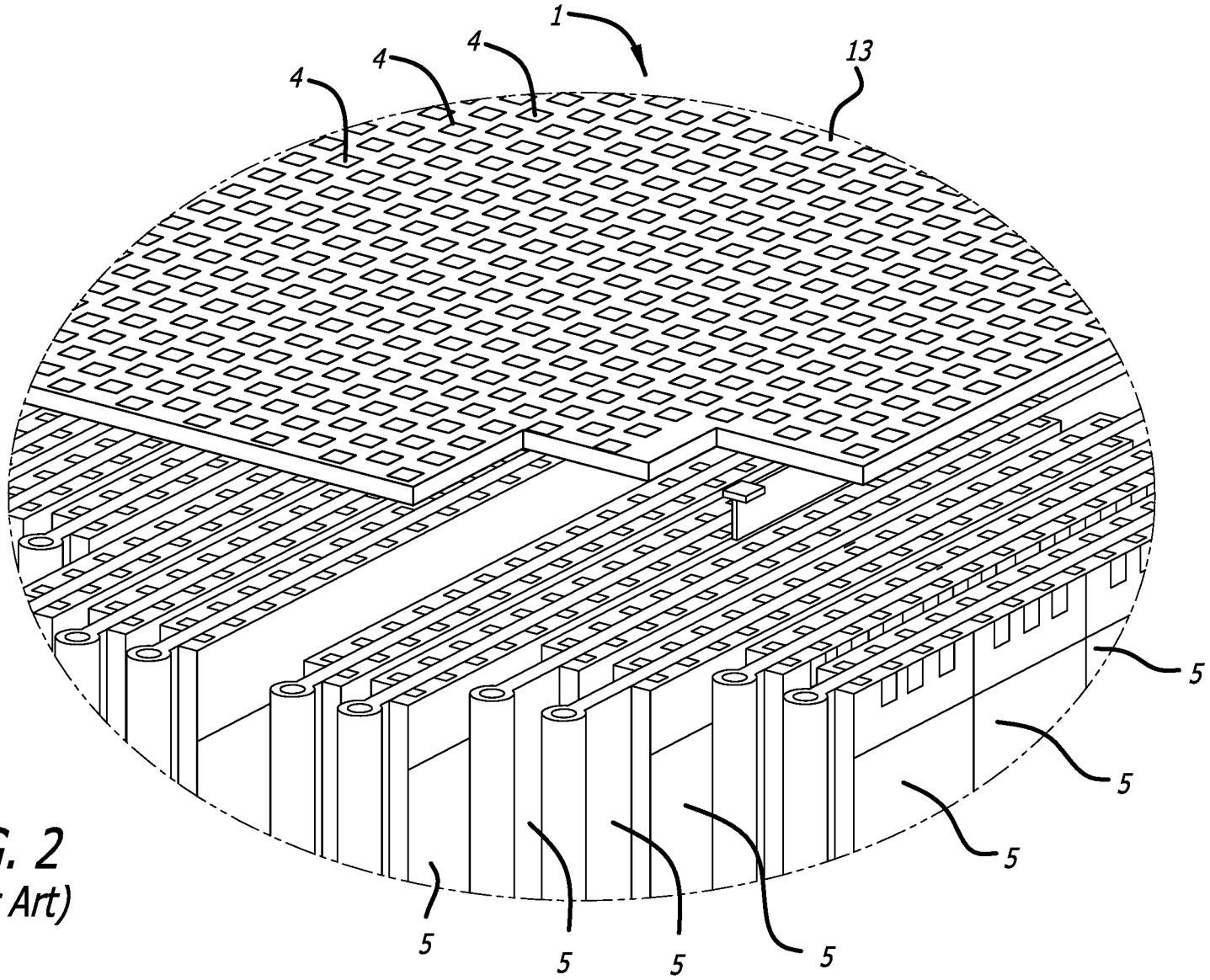
FIG. 2 (Prior Art)
FIG. 2 is a perspective, cut-away, exploded view of the AESA of FIG. 1.
Figure 7:
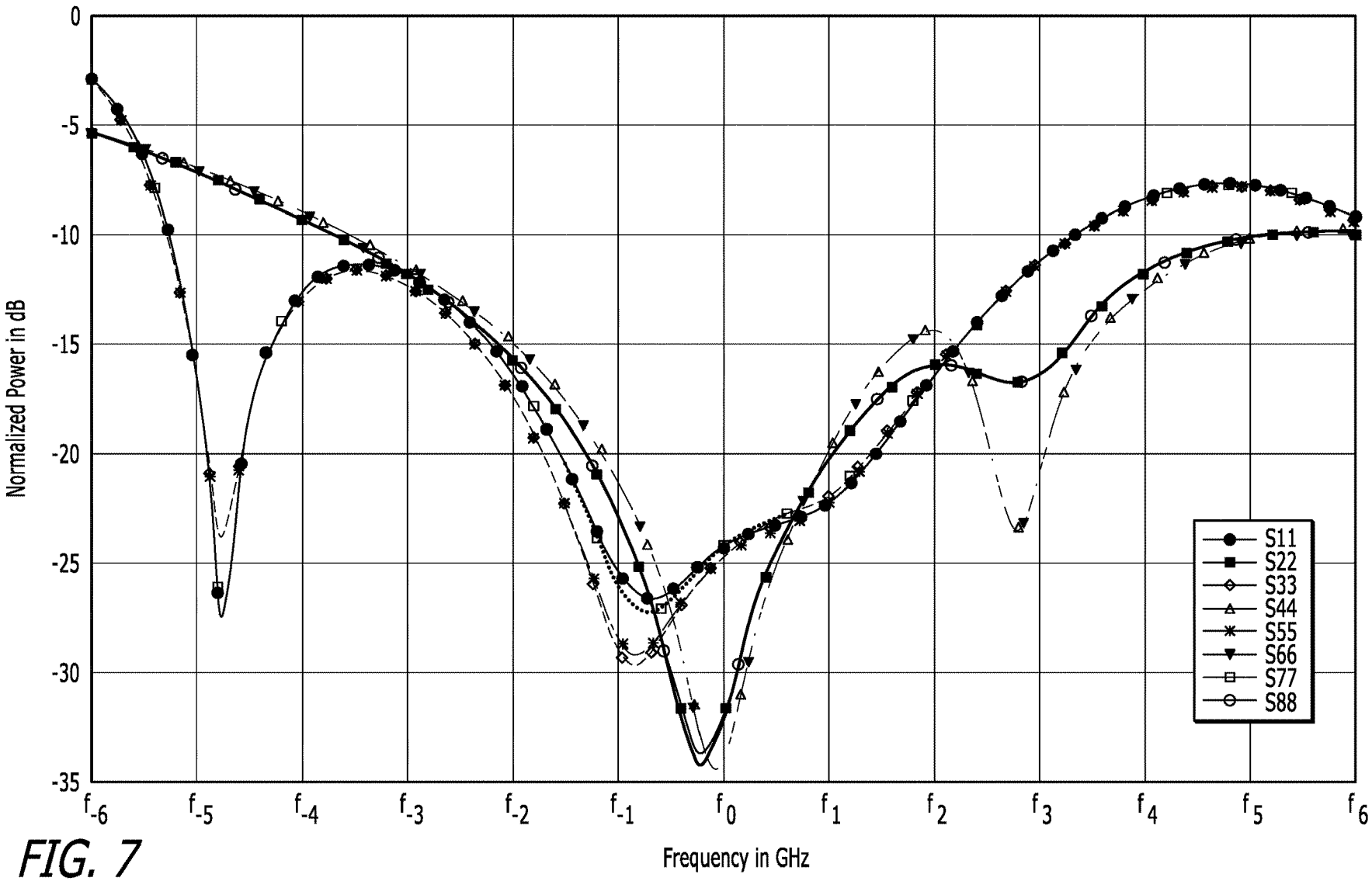
FIG. 7 is a plot of the simulated RF return loss of the radiator-waveguide portion of the quad-pack RF module of FIG. 3.
Figure 8:
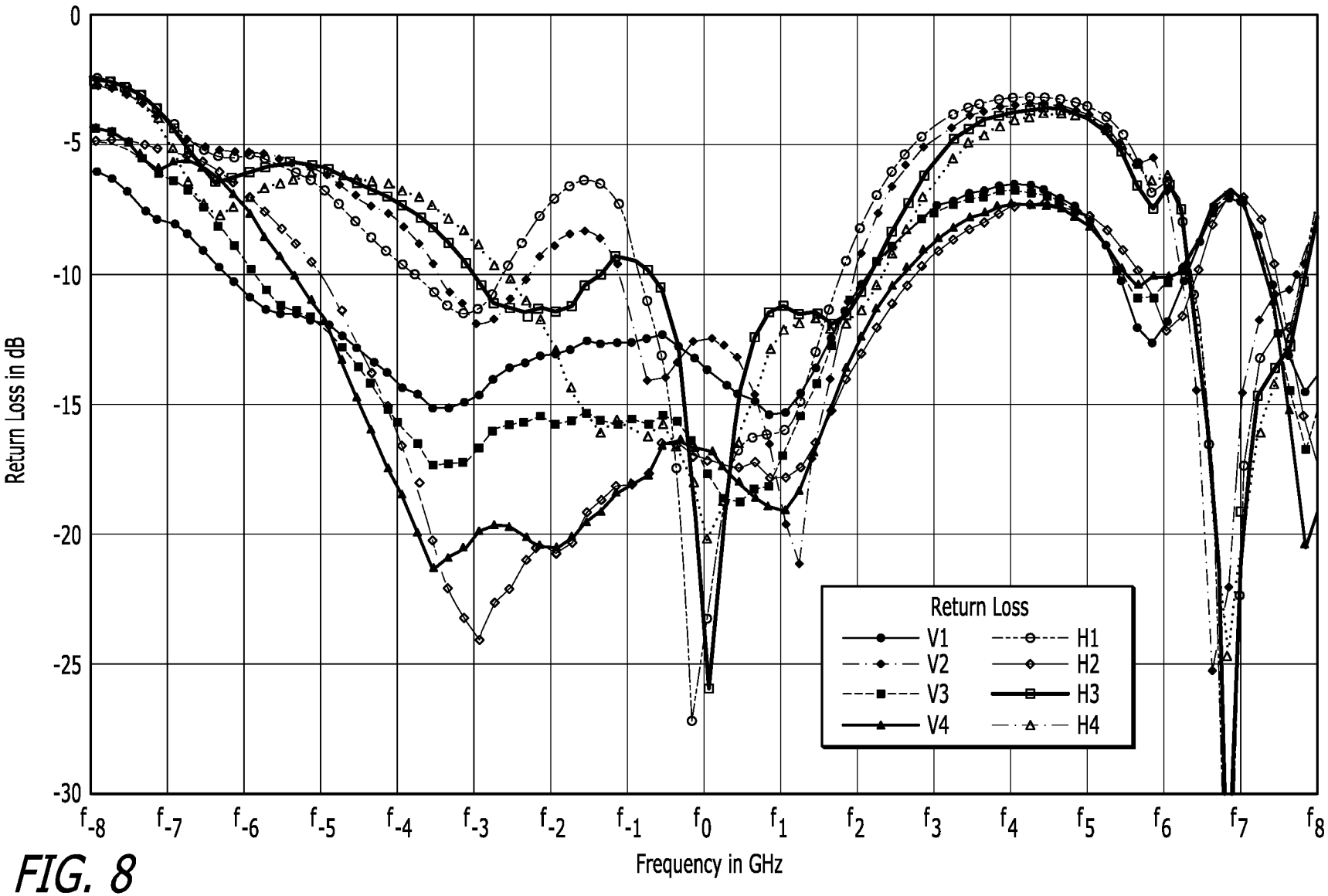
FIG. 8 is a plot of the measured RF return loss of the actual quad-pack RF module of FIG. 5.

It should be appreciated that air-filled quad-ridge radiators 104 provide comparable RF performance to the Duroid®-filled radiators 4 illustrated in FIGS. 1 and 2. For example, as illustrated in FIG. 7, the return loss performance (S11, S22, S33, S44, S55, S66, S77, and S88) for the quad-pack RF module 100 was simulated for each of the ports, with the odd-numbered ports (P1, P3, P5, and P7) corresponding to the vertically polarized RF signals, and the even-numbered ports (P2, P4, P6, and P8) corresponding to the horizontally polarized RF signals. As illustrated, the return loss curves show that the bandwidth, or a 1.5:1 Voltage Standing Wave Ratio (VSWR), or a return loss of −14 dB is approximately six percent about the center frequency of $F_0$ GHz. Not shown in FIG. 7 is the cross-coupling coefficients (e.g., S12, S13, etc.) because the values are low and deemed insignificant. The return loss performance (S11, S22, S33, S44, S55, S66, S77, and S88) for an actual RF module (shown in FIG. 5) fabricated in accordance with a quad-pack RF module 100 in the equilateral triangular grid array illustrated in FIG. 6 was measured for each of the ports P1-P8, and is illustrated in FIG. 8. The RF module shown in FIG. 5 was not even tuned or adjusted to improve the return loss performance. Nonetheless it tracks the simulated return loss performance in FIG. 7 well, and is very satisfactory over the entire operating frequency band. The air-filled quad-ridge radiator 104 provides a wide operational bandwidth that extends toward the lower end of the frequency band without being cutoff.

As illustrated in FIGS. 9*a* and 9*b*, the gain performance for the quad-pack RF module 100 was separately simulated for the vertical (along y-axis) polarization and horizontal (along x-axis) patterns for both co-pol and cross-pol cases with respect to Ludwig-3 polarization definition, each along two principal planes (phi=0 and 90 degrees). This was accomplished by uniformly and simultaneously exciting the four radiators 104 via the odd numbered ports P1, P3, P5, and P7, and uniformly and simultaneously exciting the four radiators 104 via the even numbered ports P2, P4, P6, and P8, at the center frequency $F_0$ GHz. For both polarization cases, it can be seen that the co-pol gain level is 30 dB higher than the cross-pol gain level. This is an indication that the quad-pack RF module 100, when it is built with precision, can provide a high co-pol gain level over the cross-pol gain level.

Although quad-ridge radiators for use in dual-polarization applications have been described herein, it should be appreciated that bi-ridge radiators can be used in single-polarization applications, resulting in the same advantages. For example, with reference to FIG. 10, in which the frontal metalized wall is depicted to be transparent to show inside, a probe 112*a* extends into the waveguide 102 for launching a linearly polarized RF signal (TE10 mode) that propagates through the waveguide 102 to an air-filled bi-ridge radiator 154, which is similar to the previously described air-filled quad-ridge radiator 104, with the exception that the bi-ridge radiator 154 only has one pair of opposing axial ridges 116*a* that advantageously interacts with the linearly co-polarized RF signal. The aperture dimension of the bi-ridge radiator 154 may be made to be $0.43\lambda_0 \times 0.43\lambda_0$ at the center frequency ($F_0$), which allows an array of closely packed elements that avoid the grating lobe issue. As shown by the radiated gain pattern in FIG. 11, the bi-ridge radiator 154 has very good co-pol pattern performance, and as shown by the return loss curve in FIG. 12, the bi-ridge radiator 154 has an excellent bandwidth.

Although the waveguide 102 and radiator 104 have been described as being rectangular in nature, it should be appreciated that the waveguide 102 and radiator 104 may be circular in order to support circularly polarized RF signals (such as RHCP or LHCP), which are often used for communication purposes, as opposed to radar purposes. In this case, the circular radiator may include one or two pairs of axial ridges much like the air-filled quad-ridge radiator 104 with the accompanying advantages described above. For example, as illustrated in FIG. 13, a circular radiator 164 may comprise an outer metalized circular wall 174 (shown in phantom) and a plurality of axial ridges 176 extending along the inner surface of the outer wall 174. In the illustrated embodiment, two orthogonal pairs of opposing axial ridges 176*a*, 176*b* extend within the outer wall 174. Alternatively, as shown in FIG. 14, a circular radiator 184 may comprise the outer metalized circular wall 174 (shown in phantom) and only one pair of opposing axial ridges 176*a*, 176*b* for linear polarization applications. Notably, as illustrated in FIG. 15, the use of circular radiators, due to their geometry, allows them to be more closely packed in an array than the corresponding rectangular radiators, thereby allowing the scan angle of the array to be increased without grating lobes.

Having described the integrated RF module, one method of manufacturing an AESA using an HTCC or LTCC process 200 will now be described with respect to FIG. 16. First, a plurality of HTCC or LTCC sheets are provided. This can be accomplished by cutting a pre-fabricated HTCC or LTCC tape into a plurality of sheets (step 202). The HTCC tape may, e.g., be composed of alumina for the HTCC process or a glass-ceramic composite for the LTCC process. Next, each of the HTCC/LTCC sheets are individually processed, and in particular, via holes are punched into the sheets (step 204). Then, cut outs are made in each of the HTCC/LTCC sheets to form the shape of the radiators, including their outer walls, axial ridges, and voids, and to subsequently accommodate MMICs (step 206). Such holes, cut outs, or notches can be formed using, e.g., laser cutting.

The HTCC/LTCC sheets are then metalized by filling the via holes with electrically conductive material, printing or painting electrical traces to create electric circuit patterns and discrete components (such as resistors, capacitors, inductors, or transformers) on the sheets, printing or painting layers of the outer electrical coating or walls for the waveguides, transmission lines, and radiators, and printing or painting layers of the inner conductors of the transmission lines and the probes. Preferably, the electrically conductive material has a melting point above the temperature of the HTCC process or LTCC process (e.g., tungsten for the HTCC process, and copper, silver, or gold or the LTCC process) (step 208). Alternatively, the pre-fabricated tape can be already metalized, in which case, the fabricated tape can be etched to form the traces, electrically conductive material for the discrete components, waveguides, transmission lines, and probes.

Next, the sheets are stacked on top of each other and laminated under high pressure (e.g., 1000 to 2000 psi) (step 210). Next, the laminated sheet assembly is sintered at a suitable temperature (e.g., above 1500° C. or an HTCC process, and below 900° C. for an LTCC process) to form a ceramic monolithic structure (step 212). The monolithic structure is then plated with an electrically conductive material, such as nickel or gold, which creates an electrically conductive coating on the inner and outer surfaces of the radiators (step 214). The MMICs are then affixed within the cavities of the ceramic monolithic structure and bonded or soldered to the electrical circuit patterns (step 216).

The ceramic monolithic structure is then diced into a number of individual integrated RF modules, which in the illustrated embodiment, may be a number of quad-pack RF modules (step 218). The quad-pack RF modules are then tested and tuned to specified RF performance requirements (step 220). Lastly, the quad-pack RF modules are stacked and affixed together (e.g., via bonding) to form the AESA (step 222).

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

We claim:

1. A method of manufacturing an integrated dual-polarization radio frequency (RF) integrated radiator-transmit/receive module (IRTRM), comprising:

structurally forming at least one RF waveguide and at least one RF radiator from a metalized ceramic material, the at least one RF waveguide and the at least one RF radiator being operatively coupled with each other, each of the at least one RF radiator comprising an outer wall and two orthogonal pairs of axial ridges, wherein each of the axial ridges directly extends from an inner surface of the outer wall, and wherein each of the axial ridges is connected to the inner surface of the outer wall, and is in a form of a parallelepiped;

simultaneously sintering the metalized ceramic material to create a monolithic structure comprising the at least one RF waveguide and the at least one RF radiator, which are formed as a single integrated unit; and operatively coupling RF circuitry to the at least one RF waveguide.

2. The method of claim 1, wherein each of the axial ridges comprises at least one pair of opposing ridges.

3. The method of claim 2, wherein the at least one pair of opposing ridges comprises two pairs of opposing ridges that are orthogonal to each other.

4. The method of claim 1, wherein the outer wall of each of the at least one RF radiator is rectangular.

5. The method of claim 1, wherein the outer wall of each of the at least one RF radiator is circular.

6. The method of claim 1, wherein each of the at least one RF waveguide is a dielectric waveguide composed of ceramic material.

7. The method of claim 1, wherein each of the at least one RF radiator has a void filled with air.

8. The method of claim 1, wherein the ceramic material is high temperature co-fired ceramic (HTCC) material that is sintered at a temperature greater than 1500° C.

9. The method of claim 1, wherein the ceramic material is low temperature co-fired ceramic (LTCC) material that is sintered at a temperature less than 900° C.

10. The method of claim 1, further comprising:

structurally forming at least one RF transmission line from the ceramic material, the at least one transmission line being operatively coupled between the RF circuitry and the at least one RF waveguide; and simultaneously sintering the at least one transmission line with the at least one RF waveguide and the at least one RF radiator to create the monolithic structure.

11. The method of claim 1, wherein forming the at least one RF waveguide and the at least one RF radiator from the ceramic material comprises laminating a plurality of ceramic material layers together, and wherein the ceramic material is metallized by forming electrically conductive patterns on at least one of the ceramic material layers prior to laminating the plurality of ceramic material layers together.

12. The method of claim 11, wherein forming the at least one RF radiator further comprises forming a cutout in at least one of the plurality of ceramic material layers to create the axial ridges.

13. The method of claim 11, wherein the RF circuitry comprises at least one monolithic microwave integrated circuit (MMIC), and operatively coupling the RF circuitry to the at least one RF waveguide comprises forming at least one cut out in at least one of the ceramic material layers, such that at least one cavity is formed in the monolithic structure, and affixing the at least one MIMIC respectively into the at least one cavity.

14. The method of claim 1, further comprising disposing an electrically conductive material on exposed surfaces of the at least one RF radiator after the monolithic structure has been created.

15. The method of claim 1, wherein the at least one RF waveguide comprises a plurality of waveguides, and the at least one RF radiator comprises a plurality of radiators.

16. The method of claim 1, wherein the RF circuitry comprises RF transmit/receive circuitry.

17. A method of manufacturing an active electronically scanned array (AESA), comprising:

stacking a plurality of integrated RF modules together, each of the integrated RF modules being manufactured in accordance with the method of claim 1; and affixing the plurality of integrated RF modules together.

18. An integrated dual-polarization radio frequency (RF) module, comprising:

at least one radiator, each of which includes an outer wall and two orthogonal pairs of axial ridges, wherein each of the axial ridges directly extends from an inner surface of the outer wall, and wherein each of the axial ridges is connected to the inner surface of the outer wall, and is in a form of a parallelepiped;

at least one waveguide respectively operatively coupled to the at least one RF radiator;

RF circuitry operatively coupled to the at least one RF waveguide; and wherein the at least one RF radiator and the at least one RF waveguide are formed of a monolithic metalized ceramic structure as a single integrated unit, and the RF circuitry is affixed to the monolithic metalized ceramic structure.

19. The integrated RF module of claim 18, wherein each of the axial ridges comprises at least one pair of opposing ridges.

20. The integrated RF module of claim 19, wherein the at least one pair of opposing ridges comprises two pairs of opposing ridges that are orthogonal to each other.

21. The integrated RF module of claim 18, wherein each of the at least one RF waveguide is a dielectric waveguide.

22. The integrated RF module of claim 18, wherein each of the at least one RF radiator has a void filled with air.

23. The integrated RF module of claim 18, wherein the ceramic structure is composed of high temperature co-fired ceramic (HTCC) material.

24. The integrated RF module of claim 18, wherein the ceramic structure is composed of low temperature co-fired ceramic (LTCC) material.

25. The integrated RF module of claim 18, further comprising at least one RF transmission line operatively coupled between the RF circuitry and the at least one RF waveguide, wherein the at least one RF transmission line is formed of the monolithic metalized ceramic structure.

26. The integrated RF module of claim 25, wherein each of the at least one RF transmission line comprises a probe extending into a respective one of the at least one RF waveguide.

27. The integrated RF module of claim 18, wherein the monolithic metalized ceramic structure comprises at least one cavity, and the RF circuitry comprises at least one monolithic microwave integrated circuit (MMIC) respectively affixed within the at least one cavity.

28. The integrated RF module of claim 18, wherein the at least one RF waveguide comprises a plurality of waveguides, and the at least one RF radiator comprises a plurality of radiators.

29. The integrated RF module of claim 18, wherein the RF circuitry comprises RF transmit/receive circuitry.

30. An active electronically scanned array (AESA), comprising a plurality of the integrated RF modules of claim 18 affixed to each other.

31. A method of operating an integrated dual-polarization radio frequency (RF) module, comprising:

launching, by a first electrically conductive probe, a vertically polarized RF signal into a waveguide;

launching, by a second electrically conductive probe, a horizontally polarized RF signal into the waveguide;

propagating, through the waveguide, the vertically polarized RF signal and the horizontally polarized RF signal; and radiating, by the radiator, the vertically polarized RF signal and the horizontally polarized RF signal, wherein the radiator includes an outer wall and two orthogonal pairs of axial ridges, wherein each of the axial ridges directly extends from an inner surface of the outer wall, and wherein each of the axial ridges is connected to the inner surface of the outer wall, and is in a form of a parallelepiped, and wherein the waveguide is operatively coupled to the radiator, and wherein the radiator and the waveguide are formed of a monolithic metalized ceramic structure as a single integrated unit.

32. The method of claim 31, further comprising at least one of transmitting or receiving, by circuitry, the vertically polarized RF signal and the horizontally polarized RF signal, wherein the circuitry is operatively coupled to the waveguide.

33. The method of claim 32, wherein the circuitry is affixed to the monolithic metalized ceramic structure.

* * * * *